United States Patent [19]

Martin

[11] 4,120,640

[45] Oct. 17, 1978

[54] BURNER FOR LIQUID FUEL

[75] Inventor: Charles K. Martin, Boonton, N.J.

[73] Assignee: Infern-O-Therm Corporation, Keyport, N.J.

[21] Appl. No.: 770,195

[22] Filed: Feb. 18, 1977

[51] Int. Cl.[2] ..... F23D 15/02

[52] U.S. Cl. ..... 431/353; 431/173

[58] Field of Search ..... 431/353, 242, 248, 352, 431/351, 173, 9, 181, 182, 185; 239/400, 399, 403, 404, 405; 110/97 D

[56] References Cited

U.S. PATENT DOCUMENTS

| | | | |
|---|---|---|---|
| 1,880,011 | 9/1932 | Boynton | 165/9.2 |
| 3,327,762 | 6/1967 | Saha | 431/173 |
| 3,339,613 | 9/1967 | Saha | 431/173 |
| 3,684,424 | 8/1972 | Zink | 431/353 |
| 3,857,672 | 12/1974 | Reed et al. | 431/353 |
| 3,859,786 | 1/1975 | Azelborn et al. | 431/353 |
| 3,951,584 | 4/1976 | Thekdi | 431/353 |
| 3,975,141 | 8/1976 | Sweet | 431/353 |
| 4,021,188 | 5/1977 | Yamagishi et al. | 431/353 |
| 4,054,028 | 10/1977 | Kawaguchi | 431/353 |

*Primary Examiner*—Henry C. Yuen

*Attorney, Agent, or Firm*—Carella, Bain, Gilfillan & Rhodes

[57] ABSTRACT

Disclosed is a burner for liquid fuels which includes a combustion tube having an inner surface defining a combustion chamber, an end bell which mounts a nozzle for introducing the liquid fuel into the combustion chamber in the form of a fine spray, and an auxiliary air introduction means, also mounted to the end bell, which produces an auxiliary vortex flow of air around and concentric with the nozzle so as to entrain the fine spray of liquid fuel and form a fuel-air mixture. Means are provided for igniting the fuel-air mixture, and a main air introduction means is provided for producing a main vortex flow of air which serves to separate the fuel-air mixture from the inner surface of the combustion tube and to provide additional air for combustion of the fuel-air mixture. A collar means, preferably of a refractory material, is provided concentric with the nozzle. The collar means controls combustion of the fuel-air mixture by controlling the manner in which the fuel-air mixture is transported into the combustion chamber and the rate at which the fuel-air mixture mixes with the main vortex flow of air.

A baffle may be provided within the combustion chamber to further assist in effecting complete and clean combustion of the fuel-air mixture. In certain embodiments of the invention, the baffle takes the form of a right circular cylinder of a refractory material, the cylinder having an interior aperture in the shape of a cloverleaf.

8 Claims, 2 Drawing Figures

BURNER FOR LIQUID FUEL

CROSS-REFERENCES TO RELATED APPLICATIONS

To applicant's knowledge, there are no pending applications which relate to the present application for United States Letters Patent.

BACKGROUND OF THE INVENTION

1. Field of the Invention

This invention relates to furnaces generally, and more particularly to burners for liquid fuel, such as oil-burning furnaces. Burners of this type may be used for heating oil or other liquids, solid materials such as aggregates, gases, or any suitable heat-transfer medium.

2. Description of the Prior Art

The prior art includes the use of nozzles to produce a fine spray of liquid fuel, and means for producing a fuel-air mixture which is caused to burn by an ignition means. Also known to the prior art is the use of refractory materials as linings for combustion chambers, and generally for the protection of metallic and other surfaces from the effects of high temperatures present within the region in which combustion takes place.

SUMMARY OF THE INVENTION

The present invention is directed to a burner for liquid fuel including a combustion tube, having an inner surface which serves to define a combustion chamber, and an end bell which is secured to the combustion tube. Nozzle means, for atomizing the liquid fuel and introducing the liquid fuel, in the form of a fine spray, into the combustion chamber, are affixed to the end bell. Also secured to the end bell are auxiliary air introduction means for producing an auxiliary vortex flow of air around and concentric with the nozzle means. The auxiliary vortex flow of air serves to entrain the fine spray of liquid fuel and form a fuel-air mixture, and the auxiliary vortex flow of air also helps to convey the fuel-air mixture from the region of the nozzle into the combustion chamber. Means for igniting the fuel-air mixture are also provided, secured to the end bell, and a collar means, surrounding the nozzle means, serves to control combustion of the fuel-air mixture by controlling the manner in which the fuel-air mixture is transported into the combustion chamber and the rate at which the fuel-air mixture mixes with a main vortex flow of air, provided by a main air introduction means.

The main vortex flow of air separates the burning fuel-air mixture from the inner surface of the combustion tube, and it also serves to provide additional air for combustion of the fuel-air mixture. The main air introduction means, which produces the main vortex flow of air, is itself secured to the end bell.

In some embodiments of the invention, the collar means is advantageously constructed in the shape of a right circular cylindrical shell, or ring, which surrounds the nozzle means, and suitable materials for the collar include refractory materials.

Additional embodiments of the present invention add a baffle means, secured to the inner surface of the combustion tube. The baffle means, which may advantageously be constructed of a refractory material, contributes to complete and clean combustion of the fuel-air mixture. The baffle means may advantageously include an interior aperture in the shape of a cloverleaf.

An object of the present invention is to provide a burner for liquid fuels which produces complete, high efficiency combustion of the liquid fuel.

Another object of the present invention is to provide a burner for liquid fuels which is clean-burning.

A further object of the present invention is to provide a burner for liquid fuels which combines clean burning with the highest possible $CO_2$ content in the fuel gases emitted by the burner.

A further object of the present invention is to provide a burner for liquid fuels which reduces the temperatures to which the fuel nozzle and ignitor electrodes are subjected, thereby providing longer useful lives for these critical components of the burner.

BRIEF DESCRIPTION OF THE DRAWINGS

A complete understanding of the invention may be obtained from the detailed description which follows, together with the accompanying drawings, wherein.

DESCRIPTION OF THE INVENTION

Figure 1:
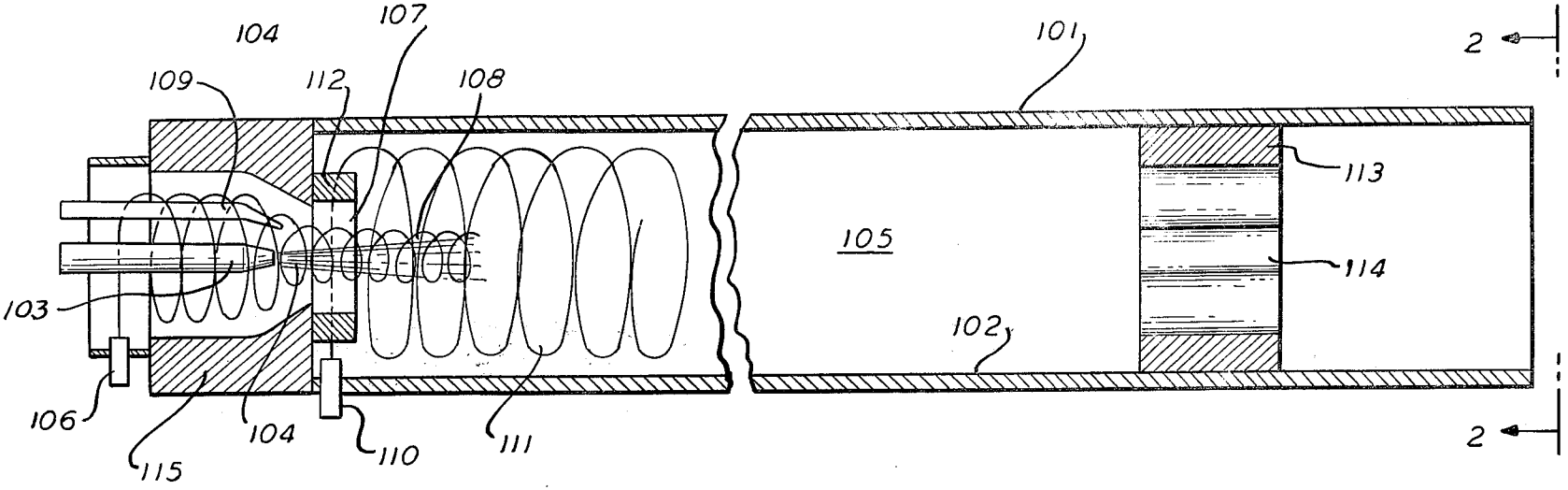
FIG. 1 is a cross-sectional view of a burner for liquid fuels according to the present invention; and, FIG. 2 is a view of the baffle means, as indicated in FIG. 1, showing the interior aperture in the shape of a cloverleaf.

The present invention may be understood by reference to the illustrative embodiment of the burner for liquid fuel shown in the cross-sectional view of FIG. 1.

Referring to FIG. 1, the burner includes a combustion tube 101 of steel or other suitable material, and having an inner surface 102, which may be lined with a refractory material so as to withstand the high temperatures resulting from combustion of the liquid fuel. This inner surface 102 of combustion tube 101 serves to establish a confined combustion chamber, designated 105 in FIG. 1, in which the liquid fuel is burned.

An end bell 115 is secured to the combustion tube 101 at one end of combustion tube 101. Nozzle means 103, which is secured to end bell 115, serves to atomize the liquid fuel and introduce the liquid fuel in the form of a fine spray, designated 104 in FIG. 1, into combustion chamber 105.

Also secured to end bell 115 is auxiliary air introduction means 106, shown as a tube or pipe in FIG. 1, which produces an auxiliary vortex flow 107 of air around nozzle means 103, and concentric with nozzle means 103, so as to entrain the fine spray 104 of liquid fuel and form a fuel-air mixture, designated 108 in FIG. 1. Fuel-air mixture 108 is carried, both by the momentum imparted to the fine spray 104 of liquid fuel by nozzle means 103 and by auxiliary vortex flow 107 of air, into combustion chamber 105.

Means 109, for igniting fuel-air mixture 108, are also secured to end bell 115. Means 109 for igniting fuel-air mixture 108 may, for example, be a pair of electrodes to which a high-voltage electric current is applied, thereby causing an electric arc between the electrodes which ignites fuel-air mixture 108. Of course, other apparatus may also be utilized as means 109 for igniting fuel-air mixture 108.

Main air introduction means 110, shown as a tube or pipe in FIG. 1, which is secured to end bell 115, serves to produce a main vortex flow 111 of air. Collar means 112, also affixed to end bell 115, co-operates with main air introduction means 110 to produce the main vortex flow 111 of air, which provides several beneficial effects. Main vortex flow 111 of air separates the burning fuel-air mixture 108 from the inner surface 102 of combustion tube 101, thereby protecting inner surface 102 of combustion tube 101 from the extremely high temperatures of the burning fuel-air mixture 108. Main vortex flow 111, produced by the co-operative action of collar means 112 and main air introduction means 110, also controls the transportation of the fuel-air mixture 108 into combustion chamber 105, and the rate at which the fuel-air mixture 108 mixes with main vortex flow 111 of air, thereby controlling combustion of the liquid fuel. Main vortex flow 111 of air also serves to provide additional air for combustion of fuel-air mixture 108, in addition to that furnished by auxiliary air introduction means 106.

Collar means 112, shown in cross-section in FIG. 1, has been found to be particularly efficacious in controlling combustion of fuel-air mixture 108 when constructed in the form of a right circular cylindrical shell surrounding the nozzle means 103. Preferably, collar means 112 is mounted to end bell 115 so as to be concentric with nozzle means 103. Such an arrangement, with collar means 112 in the form of a right circular cylindrical shell surrounding and concentric with nozzle means 103, has been found to work especially well in creating main vortex flow 111 of air, and in controlling combustion of fuel-air mixture 108 to result in clean and efficient burning of the liquid fuel.

Although any material suited to the temperatures and mechanical stresses involved can be used for collar means 112, it has been found that refractory materials, such as that offered for sale by the A.P. Green Refractory Products Company under the trade name "Greencast 94," work well in this application.

A further improvement in burner operation is achieved by providing, within combustion chamber 105, a baffle means 113 such as is shown in FIG. 1. Baffle means 113 is secured to the inner surface 102 of combustion tube 101, and it causes the air and fuel from the combustion chamber 105 to exit at a high velocity, thus ensuring complete clean burning with the highest possible $CO_2$ content in the fuel gases emitted from the combustion process. It is necessary that baffle means 113 include an interior aperture 114, defined by surfaces of baffle means 113, to permit passage of the burning fuel-air mixture 108.

Figure 2:
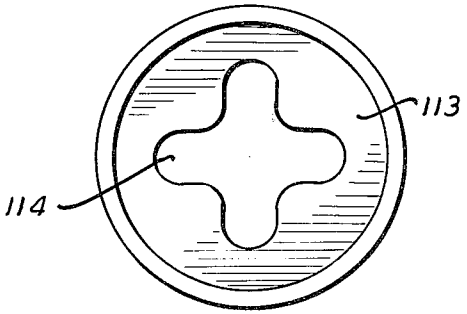

It has been found that an interior aperture 114, in baffle means 113, that is generally in the shape of a cloverleaf is particularly efficient in promoting clean burning with highest heat output. Burner efficiencies up to 90% are realized with this configuration, which is shown in end view in FIG. 2. Suitable materials for the baffle means 113 include various refractory materials, with excellent results being achieved with the material designated "Greencast 94," available from the A.P. Green Refractory Products Co.

What is claimed is:

1. A burner for liquid fuel, comprising:

(a) a combustion tube, having an inner surface;

(b) an end bell, secured to the combustion tube;

(c) nozzle means, secured to the end bell, for atomizing the liquid fuel and introducing the liquid fuel as a fine spray, into a combustion chamber defined by the inner surface of the combustion tube;

(d) auxiliary air introduction means, secured to one end of the end bell, for producing an auxiliary vortex flow of air around and concentric with the nozzle means so as to entrain the fine spray of liquid fuel and form a fuel-air mixture, the fuel-air mixture being carried by the auxiliary vortex flow of air into the combustion chamber;

(e) means for igniting the fuel-air mixture;

(f) main air introduction means, secured to the other end of the end bell, for producing a main vortex flow of air around the fuel-air mixture, the main vortex flow of air serving to separate the fuel-air mixture from the inner surface of the combustion tube and to provide additional air for combustion of the fuel-air mixture; and, (g) collar means, secured to the end bell and surrounding the nozzle means, the collar means for controlling combustion of the fuel-air mixture by controlling the manner in which the fuel-air mixture is transported into the combustion chamber and the rate at which the fuel-air mixture mixes with the main vortex flow of air, the collar means is a right circular cylindrical shell surrounding the nozzle means.

2. A burner for liquid fuel as recited in claim 1, in which the collar means is composed of a refractory material.

3. A burner for liquid fuel as recited in claim 2, further comprising:

baffle means, secured to the inner surface of the combustion tube, the baffle means for effecting complete and clean combustion of the fuel-air mixture.

4. A burner for liquid fuel as recited in claim 3, in which the baffle means is a right circular cylinder having surfaces defining an interior aperture in the shape of a cloverleaf.

5. A burner for liquid fuel as recited in claim 4, in which the baffle means is composed of a refractory material.

6. A burner for liquid fuel as recited in claim 1, further comprising:

baffle means, secured to the inner surface of the combustion tube, the baffle means for effecting complete and clean combustion of the fuel-air mixture.

7. A burner for liquid fuel as recited in claim 6, in which the baffle means is a right circular cylinder having surfaces defining an interior aperture in the shape of a cloverleaf.

8. A burner for liquid fuel as recited in claim 7, in which the baffle means is composed of a refractory material.

* * * * *